United States Patent [19]

Beverlin

[11] Patent Number: 4,777,666

[45] Date of Patent: Oct. 18, 1988

[54] ARCHER'S ADJUSTABLE BOW-SLING

[76] Inventor: William C. Beverlin, 649 W. Atlantic and Morris Ave., Sewell, N.J. 08080

[21] Appl. No.: 158,751

[22] Filed: Feb. 22, 1988

[51] Int. Cl.[4] ..... A41D 19/00

[52] U.S. Cl. ..... 2/161 A; 2/16; 124/88

[58] Field of Search ..... 2/161 A, 163, 159, 16, 2/20; 124/88, 89; 273/189 R

[56] References Cited

U.S. PATENT DOCUMENTS

| | | | |
|---|---|---|---|
| 1,200,580 | 10/1916 | Brenner | 2/161 A |
| 3,055,354 | 9/1962 | Gates | 124/88 |
| 3,237,950 | 3/1966 | Harvey | 2/16 X |
| 3,572,312 | 3/1971 | Foster | 124/88 X |
| 3,994,025 | 11/1976 | Petroski | 2/20 |

*Primary Examiner*—Louis K. Rimrodt
*Assistant Examiner*—J. L. Olds
*Attorney, Agent, or Firm*—Marvin C. Gaer

[57] ABSTRACT

The present invention provides an adjustable archer's bow-sling. This bow-sling includes a generally rectangular leather and elastic member, provided with finger holes connected to an adjustable length wrist strap. This rectangular member is fitted to the palm of the archer's bow hand and is of sufficient length to wrap around a bow, folding back on itself and is provided with adjustable length attachment means to attach to itself sufficiently snugly about a bow so as to support the bow against the archer's open palm, allowing the bow hand to relax while aiming and shooting arrows.

4 Claims, 2 Drawing Sheets

ARCHER'S ADJUSTABLE BOW-SLING

The present invention discloses an adjustable bow-sling for an archer, which wraps around and grips the archery bow snugly allowing the archer to hold the bow steady with a relaxed open hand while aiming and releasing an arrow, thereby improving accuracy while preventing or slowing the onset of muscular fatigue in the arm and hand.

BACKGROUND OF THE INVENTION

A problem archers encounter is that, in order to achieve accuracy, they must hold their bow as steady as possible while aiming and releasing an arrow. However, it has been the experience of archers that when they grip their bows with their bow hands and pull back on the string with their other hand, to release the arrow, the tension thereby exerted tends to cause a deflection of the bow. This deflection results in inaccuracy, while at the same time the tension in gripping the bow hastens the onset of muscular fatigue and cramping in the bow hand and arm leading to even greater inaccuracy. To solve these problems, various slings, grips and braces have been proposed of varying degrees of complexity and success.

SUMMARY OF THE INVENTION

The present invention provides a means for overcoming or reducing these problems by disclosing an adjustable glove-like bow-sling. In the embodiment described herein and more fully described in detail below, this bow-sling consists of an essentially rectangular leather and elastic strip approximately two-thirds the width of a hand palm. This palm-strip is sufficiently long to cover the palm, wrap around a bow and reattach to itself at variable positions, to adjust the degree of stability and snugness of the bow against the palm of the hand. Holes are provided in the palm-strip to allow the fingers to be extended through the strip so that the bow will fit firmly against the palm. A wrist strap is also connected to one end of the palm-strip and can be tightened at variable lengths. This strap winds around the wrist to complete the fitting of the bow-grip to the hand in a stable relation.

It is thus a principal object of this invention to provide an archer's bow-sling.

A further object of this invention is to provide a bow-sling which is adjustable to fit different size bows.

A further object of this invention is to provide a bow-sling which is adjustable to fit different size hands and wrists.

A further object of this invention is to provide a bow-sling which supports a bow snugly against an archer's open palm.

A further object of this invention is to provide a bow-sling which holds a bow steady, allowing the archer to relax the hand while releasing the arrow.

A further object of this invention is to provide a bow-sling which improves the archer's accuracy by holding the bow steady while the archer aims and releases the arrow.

A further object of this invention is to provide a bow-sling which prevents or reduces the onset of muscular fatigue or cramping in the archer's bow hand and arm.

A further object of this invention is to provide a bow-sling which allows the archer to hold or carry the bow without gripping it with the hand.

A further object of this invention is to provide a bow-sling which is economical to manufacture, durable and easy to use.

These and other objects will be apparent to those skilled in the art.

BRIEF DESCRIPTION OF THE DRAWINGS

The more specific object features and advantages of this invention will be more readily apparent from the following description wherein reference is made to the accompanying drawings illustrating the preferred embodiment of the invention. The drawings here illustrate an embodiment of the invention for the left hand, but obvious modifications will provide a right hand version.

In the drawings.

DETAILED DESCRIPTION OF THE PREFERRED EMBODIMENT

Figure 1:
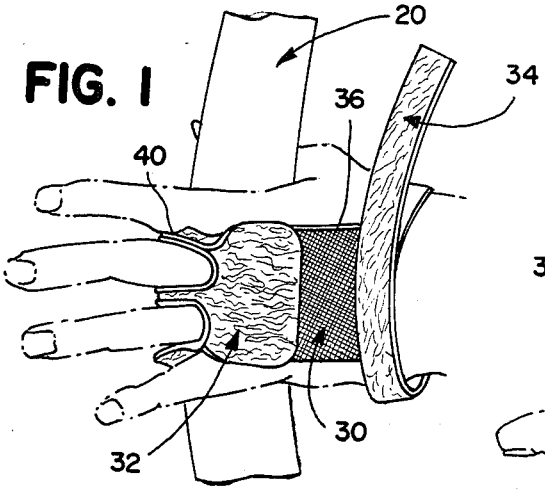
FIG. 1 is a side view of a bow being held against the open palm by the bow-sling.

Although a specific embodiment of the invention has been illustrated in the drawings, and the following description is presented in reference to this embodiment, this description is not intended to limit the scope of the invention which is defined in the appended claims.

FIG. 1 illustrates a side view of a portion of a bow, generally designated by numeral 20, being held against the open palm of the archer's hand by the bow-sling, generally designated by the numeral 30. It is seen that the bow-sling 30 consists of a soft leather or leather-like material forming a generally rectangular palm-strip, a portion of which is visible and designated as 32, containing two holes for the insertion of the archer's fingers, bordered by the folded contours 40 of the palm-strip. The back hand end of the palm-strip 32 is connected to an elastic strip 36, which in turn is connected at the wrist end to the narrow leather or leather-like wrist strap 34 which wraps around the wrist and attaches to itself.

Figure 2:
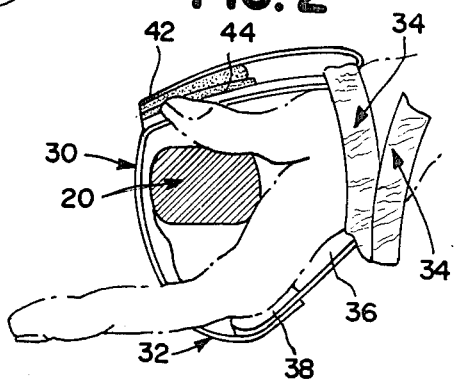
FIG. 2, is a top view of the bow-sling wrapped around the bow holding it against the open palm.

FIG. 2 provides a top view of the bow-sling 30, wrapped around the bow 20, holding it against the open palm. Here it is seen that the palm-strip 32 wraps around the bow and passes under and over the wrist strap 34 as the palm-strip folds back over itself and attaches to itself at variable tension by the loop and hook attachment pads 42 and 44, respectively. An example of these loop and hook pads is the product sold under the trademark VELCRO. It is also seen that the wrist strap 34 winds around the wrist passing through the looped palm strip 32 and is connected at one end to the palm strip 32 via the elastic band 36, which is sandwiched between the palm strip 32 and a leather strip 38, all being sewn together in the sandwiched arrangement.

Figure 3:
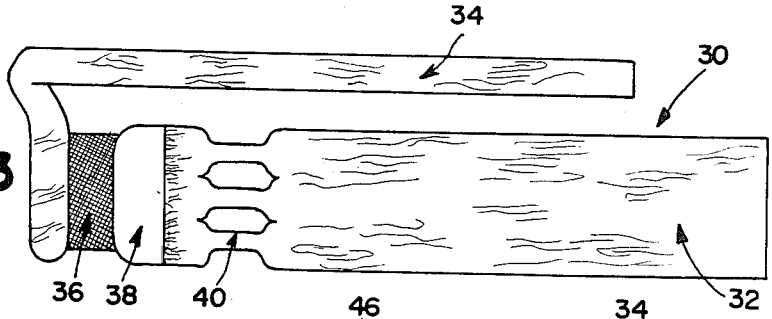
FIG. 3 shows one side of the bow-sling.

FIG. 3 is a view of one side of the bow-sling 30. Illustrated is a generally rectangular leather or leather-like palm-strip 32, which provides two finger holes near one end; the holes are bordered by folded portions of the palm-strip 40. At finger hole end, an elastic strip 36 is connected to the palm grip 32, by being sandwiched between the palm-strip 32 and another leather strip 38 running across the palm-strip 32 at the finger hole end and sewn to the palm-strip through the elastic strip 36. The opposite end of the elastic strip 36 is connected to a narrow leather or leather-like wrist strap 34. The elastic strip 36 provides a resilient shock absorbent mechanism which reduces the shock to the hand and arm when the bow's shape is restored after the arrow is released.

Figure 4:
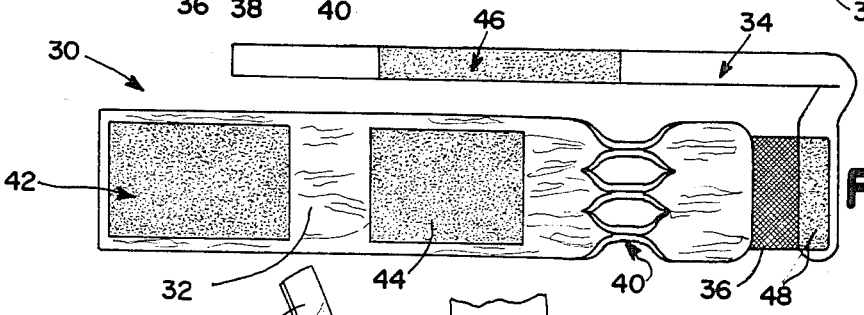
FIG. 4 shows the side of the bow-sling opposite to that of the side of FIG. 3.

FIG. 4 is the opposite side of the bow-sling 30 illustrated in FIG. 3. Here it is seen that the generally rectangular palm-strip 32 contains two rectangular loop and hook attachment pads 42 and 44 disposed along the longitudinal axis of the palm-strip 32 and which will attach to each other as in FIG. 2. As can be seen, these pads 42 and 44 allow for adjusting the length of the loop and the tightness of the grip on the bow. As in FIG. 3, finger holes are provided and are bordered by folded portions 40 of the palm strip formed by slitting and folding together the edges. At the finger hole end, a strip of elastic 36 connects the narrow wrist strap 34 which wraps around the archer's wrist and attaches to itself via the loop pad 46 and the hook pad 48 both of which are on the wrist strap. Pad 48 is connected to the wrist strap 34 at the elastic band. Loop and hook pads 46 and 48 provide for a variable size loop in the wrist strap 34 to accommodate different size wrists and are of the same material as the loop and hook pads 42 and 44.

Figure 5:
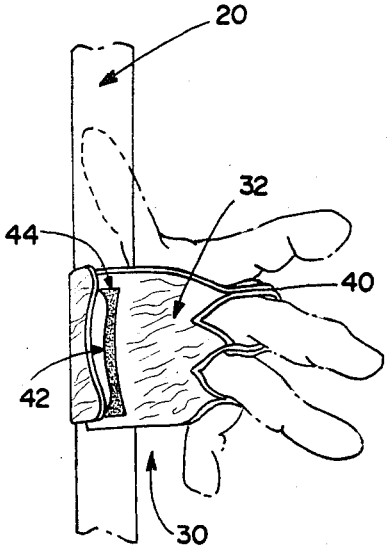
FIG. 5 is a frontal view of the bow-sling as it is wrapped around the bow with the fingers inserted.

FIG. 5 is a frontal view of the bow-sling 30 as it wraps around the bow 20 and holds the bow against the open hand with the fingers passing through the holes 40. A portion of the loop and hook pads 42 and 44 is partially visible showing how the palm strip 32 attaches to itself.

Figure 6:
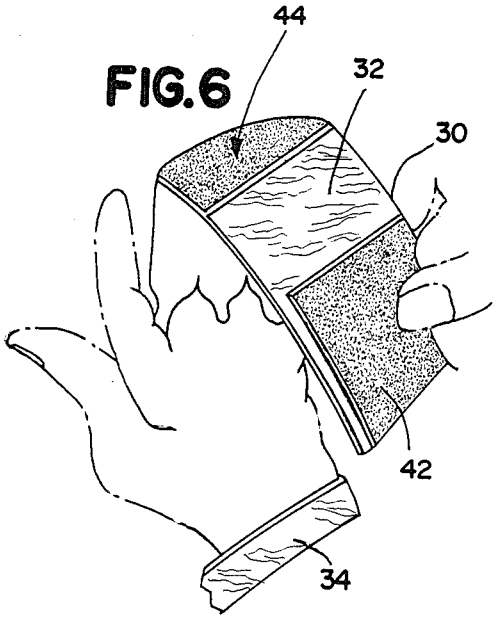
FIG. 6 is an elevated view of the bow-sling being folded back over the palm.

FIG. 6 shows the bow-sling 30 as the palm-strip 32 is being folded back over the palm before passing under and over the wrist strap 34 and attaching to itself at the loop and hook pads 42 and 44.

Figure 9:
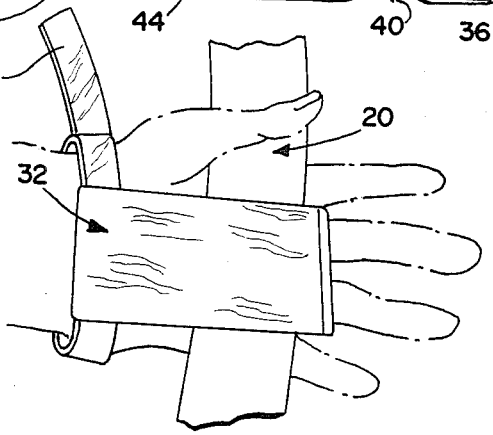
FIG. 9 is a view from the palm side, of the bow-sling attached to the hand.
Figure 7:
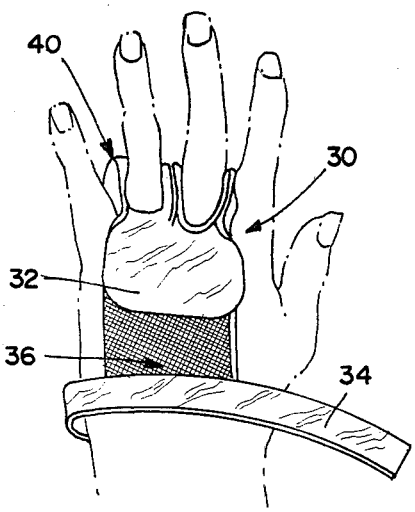
FIG. 7 is a view of the bow-sling in its attached relation to the back of the hand.
Figure 8:
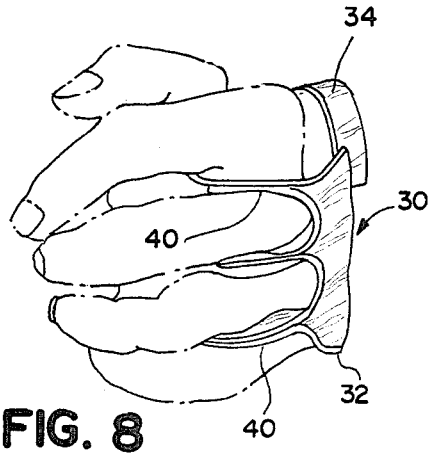
FIG. 8 is a frontal perspective view of the bow-sling fitted to the hand.

FIG. 7, FIG. 8 and FIG. 9 provide a back of the hand view, a frontal view and a palm view, respectively, of the bow-sling 30, indicating the relationship to each other of the palm-strip 32, the elastic strip 36, the wrist strap 34, and folded borders 40 of the finger holes.

These drawings indicate the middle and ring fingers inserted through the finger holes. It should be noted that it is sometimes more convenient or comfortable to insert the index and middle fingers in the finger holes. This has been found to be especially true when aiming and shooting arrows in a downward direction.

Although this invention has been illustrated and described in connection with a particular embodiment thereof, it will be apparent to those skilled in the art that various changes and modifications may be made therein without departing from the spirit of the invention or from the scope of the appended claims.

What is claimed is:

1. An adjustable bow-sling for an archer's bow hand comprising:

(a) a generally rectangular member consisting of a soft leather or leather-like material approximately three hand palms in length and approximately two-thirds the width of a palm, one side of the rectangular member containing attachment means for attaching to itself at variable lengths when folded over onto itself, this rectangular member also providing a multiplicity of finger holes near one end;

(b) an elastic strip connected at one end to the rectangular member of part (a) near the finger holes; and (c) a narrow rectangular strap member attached to the opposite end of the elastic strip of part (b), the longitudinal axis of this strap member disposed upward at approximately right angles to and in the plane of the longitudinal axis of the rectangular member of part (a), this strap member to be of sufficient length to wrap around a wrist and provided with adjustable length self-attachment means.

2. The bow-sling of claim 1, wherein the attachment means of the rectangular member of part (a) consists of two rectangular complementary hook and loop pads disposed in sequence along the longitudinal axis of the rectangular member.

3. The bow-sling of claim 1, wherein the adjustable length attachment means provided on the strap member of part (c) consists of two rectangular complementary hook and loop pads, the hook pad attached to the strap member along the elastic strip of part (b) on the same side as the attachment means of the rectangular member of part (a), and the loop pad attached to the opposite side of the strap member, at a sufficient distance to accommodate various size wrists.

4. The bow-sling of claim 1, wherein the multiplicity of finger holes provided in the rectangular member of part (a) is two, and which are located side-by-side transversely across this rectangular member beyond the attachment means of this rectangular member.

* * * * *